US005610131A

United States Patent [19]

Donoghue et al.

[11] Patent Number: 5,610,131

[45] Date of Patent: Mar. 11, 1997

[54] STRUCTURING LIQUID NONIONIC SURFACTANTS PRIOR TO GRANULATION PROCESS

[75] Inventors: Scott J. Donoghue; Kay E. Fitzgibbon, both of Tyne, England; Paul A. R. G. France, Kessel-lo, Belgium; Robin G. Hall, Tyne, England; Carole P. D. Wilkinson, Ixelles, Belgium; David W. York, Tyne, England; John C. Schmitt, Kirchheim, Germany

[73] Assignee: The Procter & Gamble Company, Cincinnati, Ohio

[21] Appl. No.: 537,751

[22] PCT Filed: Apr. 29, 1994

[86] PCT No.: PCT/US94/04843

§ 371 Date: Oct. 10, 1995

§ 102(e) Date: Oct. 10, 1995

[87] PCT Pub. No.: WO94/25553

PCT Pub. Date: Oct. 11, 1994

[30] Foreign Application Priority Data

Apr. 30, 1993 [EP] European Pat. Off. ..... 93870075

[51] Int. Cl.[6] ..... C11D 11/00

[52] U.S. Cl. ..... 510/444; 510/470; 510/475; 510/500; 510/502

[58] Field of Search ..... 252/89.1, 135, 252/174.17, 174.21, 174.23, 174.24, 544, DIG. 2; 510/444, 470, 475, 500, 502

[56] References Cited

U.S. PATENT DOCUMENTS

| | | | |
|---|---|---|---|
| 3,849,327 | 11/1974 | DiSalvo et al. | 252/109 |
| 4,123,376 | 10/1978 | Gray | 252/99 |
| 4,399,049 | 8/1983 | Gray et al. | 252/91 |
| 4,652,391 | 3/1987 | Balk | 252/99 |
| 4,755,318 | 7/1988 | Davies et al. | 252/109 |
| 4,908,159 | 3/1990 | Davies et al. | 252/559 |

FOREIGN PATENT DOCUMENTS

| | | | |
|---|---|---|---|
| 0208534 | 1/1987 | European Pat. Off. . | |
| 0340013 | 11/1989 | European Pat. Off. . | |
| 0508034A1 | 10/1992 | European Pat. Off. | C11D 3/37 |
| 0513824A2 | 11/1992 | European Pat. Off. | C11D 11/00 |
| 62-263299 | 5/1986 | Japan | C11D 10/02 |
| 2137221 | 10/1984 | United Kingdom . | |

*Primary Examiner*—Paul Lieberman
*Assistant Examiner*—Lorna M. Douyon
*Attorney, Agent, or Firm*—Jacobus C. Rasser; Jerry J. Yetter; Ken K. Patel

[57] ABSTRACT

A process for making a granular laundry detergent component or composition having a bulk density of at least 650 g/l, comprises dissolving a structuring agent in a nonionic surfactant, said structuring agent comprising a polymer, to form a pumpable premix and finely dispersing said premix with an effective amount of powder at a given operating temperature wherein the premix has a viscosity of at least 350 mPas when measured at said operating temperature and at a shear rate of $25s^{-1}$. Preferred structurants comprise polymers having more than one functional hydroxyl group, especially polyvinyl alcohols, polyhydroxyacrylic acid polymers, and polymers such as polyvinyl pyrrolidone and PVNO, as well as sugars, artificial sweeteners and their derivatives. The premix is then processed into a granular detergent by any suitable process. Fine dispersion mixing, agglomeration, or spraying the premix onto a granular base product are preferred.

10 Claims, No Drawings

STRUCTURING LIQUID NONIONIC SURFACTANTS PRIOR TO GRANULATION PROCESS

BACKGROUND OF THE INVENTION

The present invention relates to improving storage stability and physical properties of granular detergents which are rich in nonionic surfactant.

It is most useful with nonionic surfactants which are liquid at ambient temperature, and are therefore mobile. Without a suitable structurant, the nonionic surfactant tends to leak from the powder and soak into the cardboard container which forms an unsightly stain. Although it is possible to avoid this problem by using lower levels of nonionic surfactant in the composition, or by selecting nonionic surfactants which have a higher solidification temperature, this limits the flexibility of formulation.

The use of nonionic surfactants in granular detergent applications has been widely discussed in the prior art. The following references describe various processes and compositions for making granules which comprise nonionic surfactants.

U.S. Pat. No. 3,868,336, published 25th Feb., 1975 discloses the use of a powder premix comprising perborate, tripolyphosphate, nonionic surfactant and polyvinyl alcohol. The premix is dry added to other detergent components.

GB 2 137 221, published 3rd Oct., 1984 discloses a nonionic premix which comprises dissolved polyvinyl pyrrolidone (PVP) and soil release polymer. The premix is sprayed on to an absorbant detergent carrier particle. The PVP is used as a stabiliser for the soil release polymer.

EPA 0 215 637, published on 25th Mar., 1987 discloses the use of sugars and derivatives as structurants of spray dried detergent powders. Although nonionic surfactant may be present in such powders it is incorporated at relatively low levels (1.5% –4% in examples 1 to 5). Furthermore the spray dried powder has a low bulk density (324–574 g/l).

EPA 0 513 824, published 19th Nov., 1992, describes a process for granulating nonionic detergent and the use of a surface coating agent having a particle size of less than 10 micrometers to give a powder having a high content of nonionic surfactant (10–60%) and a bulk density of 0.6 to 1.2 g/ml. The use of polymers including polyethylene glycol, polyvinyl alcohol, polyvinyl pyrrolidone and carboxymethyl cellulose is disclosed (page 13, lines 17– 18). However, the benefits of using any of these polymers to structure or thicken the nonionic surfactant is not disclosed.

WO 92 6160, published on 16th Apr., 1992. This application describes (example 14) a granular detergent composition prepared by fine dispersion mixing in an Eirich RV02 mixer of a paste which comprises N-methyl glucose amide and nonionic surfactant in the presence of sodium carbonate and zeolite. There is no suggestion to use polymers as structuring agents.

One aspect of the present invention is a process for making granular nonionic detergent agglomerates having a bulk density of at least 650 g/l and which comprise higher levels of nonionic surfactant than those of the prior art, but do not have problems of mobile nonionic surfactants (i.e. nonionic surfactants with low solidification temperatures) leaking from the granules and soaking into the carton.

This problem is addressed by structuring the liquid nonionic surfactant before the dispersion and/or granulation process. This is done by dissolving a structuring agent which comprises a polymer in the nonionic surfactant. Preferred structuring agents are polymers, especially polymers having more than one functional hydroxyl group, especially polyvinyl alcohols, polyhydroxyacrylic acid polymers, and polymers such as polyvinyl pyrrolidone and PVNO. Also useful as components of the structuring agent are sugars and artificial sweeteners and their derivatives.

It is a further aspect of the present invention to provide a process for incorporating sticky materials into detergent granules while still maintaining desirable physical properties including free-flowing particles which have a good resistance to caking. Sticky materials if present at or close to the surface of the granules have a negative effect on flow properties. These materials also tend to gel upon contact with water which prevents effective dispensing of the granules from the dispensing drawer of a washing machine or from a dispensing device which is added to the wash with soiled load. In this aspect of the present invention these problems are overcome by using sticky materials as structuring agents of the nonionic surfactants thereby improving the surface properties of the granules.

In a further aspect of the invention, high bulk density granular detergent compositions and components are provided which comprise nonionic surfactants and structuring agents.

SUMMARY OF THE INVENTION

A process for making a granular laundry detergent component or composition having a bulk density of at least 650 g/l, by dissolving a structuring agent in a nonionic surfactant, said structuring agent comprising a polymer, to form a pumpable premix and finely dispersing said premix with an effective amount of powder at a given operating temperature wherein the premix has a viscosity of at least 350 mPas when measured at said operating temperature and at a shear rate of $25s^{-1}$. Preferred structurants comprise polymers having more than one functional hydroxyl group, especially polyvinyl alcohols, polyhydroxyacrylic acid polymers, and polymers such as polyvinyl pyrrolidone and PVNO, as well as sugars, artificial sweeteners and their derivatives. The premix is then processed into a granular detergent by any suitable process. Fine dispersion mixing, agglomeration, or spraying the premix onto a granular base product are preferred.

Another aspect of the present invention is components or compositions comprising nonionic surfactant and structuring agents.

DETAILED DESCRIPTION OF THE INVENTION

The process aspect of the present invention comprises two essential steps. The first process step is the formation of a nonionic surfactant premix which comprises a structuring agent. The second process step is the processing of the surfactant premix into the form of a granular detergent having the desired physical properties of bulk density, flow properties and storage characteristics.

The first process step of the invention is the preparation of a structured nonionic surfactant premix. This premix comprises two essential components which will be described in more detail below. These components are the nonionic surfactant and the structuring agent. In the first process step the structuring agent is dissolved in the nonionic surfactant.

The second process step may be based upon any of the techniques of forming granules which are known to the man skilled in the art. However, the most preferred granulation techniques for use in the present invention are fine dispersion of the structured nonionic surfactant paste in the presence of powders. One example of such a process is to pump or spray the surfactant paste into a high shear mixer. The high shear conditions in the mixer break up the surfactant paste into small droplets and distribute those droplets onto and around the powder. The process is often described as "agglomeration".

Another example of such a process is to spray the surfactant paste onto a powder under low shear conditions (such as a rotating drum). In this case the energy to break the paste into fine droplets comes at the spray nozzle, and in the low shear mixer the droplets are absorbed on to the surface, or into the pores of the powder. Preferred granulation processes are described in more detail below.

For the purposes of the invention described herein, the term structuring has been used to mean thickening or raising the solidification point of the nonionic surfactant, or both of these. It is an essential feature of the present invention that the viscosity of the premix is greater than 350 mPas when measured at the operating temperature and at a shear rate of $25s^{-1}$.

The operating temperature, as defined herein, is the temperature of the surfactant paste at the point which is sprayed or dispersed onto the powders during the granulation step of the process.

A pumpable paste is defined herein to mean a paste which has a viscosity of less than 100 000 mPas when measured at $25s^{-1}$ at the required operating temperature. Preferably the viscosity of the paste will be less than 60 000 mPas, and even more preferably less than 40 000 mPas.

Nonionic Surfactant

Suitable nonionic surfactants include compounds produced by the condensation of alkylene oxide groups (hydrophilic in nature) with an organic hydrophobic compound, which may be aliphatic or alkyl aromatic in nature. The length of the polyoxyalkylene group which is condensed with any particular hydrophobic group can be readily adjusted to yield a water-soluble compound having the desired degree of balance between hydrophilic and hydrophobic elements.

Particularly preferred for use in the present invention are nonionic surfactants such as the polyethylene oxide condensates of alkyl phenols, e.g., the condensation products of alkyl phenols having an alkyl group containing from about 6 to 16 carbon atoms, in either a straight chain or branched chain configuration, with from about 4 to 25 moles of ethylene oxide per mole of alkyl phenol.

Preferred nonionics are the water-soluble condensation products of aliphatic alcohols containing from 8 to 20 carbon atoms, in either straight chain or branched configuration, with an average of from 1 to 25 moles of ethylene oxide per mole of alcohol. Particularly preferred are the condensation products of alcohols having an alkyl group containing from about 9 to 15 carbon atoms with from about 2 to 10 moles of ethylene oxide per mole of alcohol; and condensation products of propylene glycol with ethylene oxide. Most preferred are condensation products of alcohols having an alkyl group containing from about 12 to 15 carbon atoms with an average of about 3 moles of ethylene oxide per mole of alcohol.

Many of the nonionic surfactants which fall within the definitions given above are liquid at temperatures below 40° C. (that is to say the solidification temperature is below 40° C.). The present invention has been found to be particularly useful for such nonionic surfactants.

Structuring Agent

Although any structuring agent may be chosen which has the effect of raising the viscosity or "stickiness" of the surfactant premix to the required operating window and/or increasing the solidification temperature of the premix, it has been found that structuring agents which comprise at least one polymer are particularly useful.

Preferably at least one of the components of the structuring agent is a polymer having an average molecular weight of at least 2000, and preferably at least 10000.

The group of polymers useful as structuring agents in the present invention includes the group of polymers which are derived from monomers having at least one hydroxyl functional group such as polyvinyl alcohols, polyethylene glycol and polyhydroxyacrylic acid polymers and mixtures and derivatives of these. Other polymers which are useful components of the strucuring agent include polyvinyl pyrollidone, PVNO.

The structuring agent may also comprise other ingredients. One group of such ingredients which have been found to be particularly useful comprises the group of sugars and artificial sweeteners and their derivatives.

The group of sugars useful in the present invention includes fructose, lactose, dextrose, sucrose, saccharin and sorbitol.

One particularly preferred group of structuring agents is the derivatives of sugars such as polyhydroxy fatty acid amides. Such derivatives may be prepared by reacting a fatty acid ester and an N-alkyl polyhydroxy amine. The preferred amine for use in the present invention is N-(R1).CH—CH2(CH2OH)4—CH2—OH and the preferred ester is a C12–C20 fatty acid methyl ester. Most preferred is the reaction product of N-methyl glucamine (which may be derived from glucose) with C12–C20 fatty acid methyl ester.

Methods of manufacturing polyhydroxy fatty acid amides have been described in WO 92 6073, published on 16th Apr., 1992. This application describes the preparation of polyhydroxy fatty acid amides in the presence of solvents.

In a highly preferred embodiment of the invention N-methyl glucamine is reacted with a C12–C20 methyl ester. It also says that the formulator of granular detergent compositions may find it convenient to run the amidation reaction in the presence of solvents which comprise alkoxylated, especially ethoxylated (EO 3–8) C12–C14 alcohols (page 15, lines 22–27). This directly yields nonionic surfactant systems which are preferred in the present invention, such as those comprising N-methyl glucamide and C12–C14 alcohols with an average Of 3 ethoxylate groups per molecule.

Polyhydroxy fatty acid amides are also active in the washing process as surfactants in their own right.

Other ingredients which have been found to be useful as components of the structuring agent include phthalimide, para-toluene sulphonamide, and maleimide.

The ratio of nonionic surfactant to structuring agent will vary according to exactly which nonionic surfactant and which structurant is chosen. Any ratio may be used in the present invention provided that a premix having a viscosity of at least 350 mPas when measured at the operating temperature and a shear rate of $25s^{-1}$ is produced. Typically ratios of nonionic surfactant to structuring agent in the range of 20:1 to 1:1 have been found to be particularly suitable, and preferably from 5:1 to 2:1.

Normally the detergent compositions made according to the present invention may include a wide range of other ingredients and components which are known to the man skilled in the art to have a function in the washing process. Typical examples of such ingredients which may be used in detergent compositions are given below.

Granulation Processes

An essential step of the present invention is the process of forming granules which comprise the surfactant premix described above. Many processes for granulating surfactant pastes are known to the man skilled in the art. One of these processes is spray drying of a slurry containing the surfactant. However, this is not a preferred process in the present invention because it does not generally yield a powder with a high bulk density, and further processing is needed in order to increase the bulk density. A process which is more suited to the present invention is that of fine dispersion mixing or agglomeration. In this process a powder having a relatively small particle size is mixed with a finely dispersed paste which causes the powder to stick together (or agglomerate). The result is a granular composition which generally has a particle size distribution in the range of 250 to 1200 micrometers and has a bulk density of at least 650 g/l. In the present invention the surfactant premix is used as the paste which is finely dispersed with an effective amount of powder in a suitable mixer. Suitable mixers for carrying out the fine dispersion mixing are described in more detail below. Any suitable powder may be chosen by mixing one or more of the ingredients listed below which may be conveniently handled in powder form. Powders comprising zeolite, carbonate, silica, silicate,sulphate, phosphate, citrate, citric acid and mixtures of these are particularly preferred.

It has further been found that a particularly preferred embodiment of the present invention is to spray water on to the detergent granules after the granulation step. In this embodiment of the invention at least one of the powders used should be an anhydrous powder which may be fully or partially hydrated when it comes into contact with water. A similar process has been described in GB 2 113 707, published on 10th Aug. 1983. This application describes a process in which anhydrous powders such as phosphate, carbonate, borate or sulphate are metered into a high shear mixer (a K-G Schugi [Trade name] Blender-Agglomerator) together with a liquid surfactant and water. The amount of water added is sufficient to completely hydrate the hydratable salts. The resulting agglomerates are fed into a low shear mixer having a longer residence time in order for the hydration reaction to proceed.

In the process of the present invention, in contrast, it is highly preferred to add the water into the low shear mixer, after the agglomerates have been formed. Without wishing to be bound by theory, it is believed that adding the water after the initial formation of the agglomerates promotes hydration at the surface of the agglomerates which gives rise to the desired physical characteristics.

Most preferred in the process of the present invention is the use of anhydrous sodium carbonate, or anhydrous sodium citrate, or mixtures of these. The anhydrous salts are agglomerated in the presence of a structured nonionic surfactant premix and then water is sprayed on to the resulting agglomerates in a low shear mixer. The agglomerates are finally dried in a fluid bed dryer.

Still another process which is suited to the present invention is that of preparing a granular detergent powder and spraying the surfactant premix onto that powder. The base powder may be made by any one of the processes known to the man skilled in the art, including spray drying, granulation,. (including agglomeration). Preferably different processes which are suited to the preparation of different components will be used, and then the components will be mixed together, for example by dry mixing in a rotating drum or a low shear mixer. In a preferred embodiment of the invention the surfactant premix is sprayed onto the base powder in the rotating drum or low shear mixer. p Suitable pieces of equipment in which to carry out the fine dispersion mixing or granulation of the present invention are mixers of the Fukae® FS-G series manufactured by Fukae Powtech Kogyo Co., Japan; this apparatus is essentially in the form of a bowl-shaped vessel accessible via a top port, provided near its base with a stirrer having a substantially vertical axis, and a cutter positioned on a side wall. The stirrer and cutter may be operated independently of one another and at separately variable speeds. The vessel can be fitted with a cooling jacket or, if necessary, a cryogenic unit.

Other similar mixers found to be suitable for use in the process of the invention include Diosna® V series ex Dierks & Söhne, Germany; and the Pharma Matrix® exT K Fielder Ltd., England. Other mixers believed to be suitable for use in the process of the invention are the Fuji® VG-C series ex Fuji Sangyo Co., Japan; and the Roto® ex Zanchetta & Co srl, Italy.

Other preferred suitable equipment can include Eirich®, series RV, manufactured by Gustau Eirich Hardheim, Germany; Lödige®, series FM for batch mixing, series Baud KM for continuous mixing/agglomeration, manufactured by Lödige Machinenbau GmbH, Paderborn Germany; Drais® T160 series, manufactured by Drais Werke GmbH, Mannheim Germany; and Winkworth® RT 25 series, manufactured by Winkworth Machinery Ltd., Berkshire, England.

The Littleford Mixer, Model #FM-130-D-12, with internal chopping blades and the Cuisinart Food Processor, Model #DCX-Plus, with 7.75 inch (19.7 cm) blades are two examples of suitable mixers. Any other mixer with fine dispersion mixing and granulation capability and having a residence time in the order of 0.1 to 10 minutes can be used. The "turbine-type" impeller mixer, having several blades on an axis of rotation, is preferred. The invention can be practiced as a batch or a continuous process.

Further Processing Steps

The granular components or compositions described above may be suitable for use directly, or they may be treated by additional process steps. Commonly used process steps include drying, cooling and/or dusting the granules with a finely divided flow aid. In addition the granules may be blended with other components in order to provide a composition suitable for the desired end use. Any type of mixer or dryer (such as fluid bed dryers) may be found to be suitable for this purpose. The finely divided flow aid, if used, may be chosen from a wide variety of suitable ingredients such as zeolite, silica, talc, clay or mixtures of these.

Compositions

Another aspect of the present invention is the composition of detergent components comprising nonionic surfactant.

Components having a bulk density of greater than 650 g/l and comprising from 10% to 50% by weight of nonionic surfactant and from 5% to 30% by weight of one of the structuring agents listed above fall within the scope of the present invention. The ratio of nonionic surfactant to structuring-agent will vary according to exactly which nonionic surfactant and which structurant is chosen. Any ratio may be used in the present invention provided that a premix having a viscosity of at least 350 mPas when measured at the operating temperature and a shear rate of $25s^{-1}$ is produced. Typically ratios of nonionic surfactant to structuring agent in the range of 20:1 to 1:1 have been found to be particularly suitable, and preferably from 5:1 to 2:1.

Other ingredients which may be used in making the compositions of the present invention will be described below.

Normally the granular detergent will also contain other optional ingredients. Examples of such ingredients which are commonly used in detergents are given in more detail hereinbelow

Anionic Surfactants

Alkyl Ester Sulfonate Surfactant

Alkyl Ester sulfonate surfactants hereof include linear esters of $C_8$–$C_{20}$ carboxylic acids (i.e. fatty acids) which are sulfonated with gaseous $SO_3$ according to "The Journal of the American Oil Chemists Society" 52 (1975), pp. 323–329. Suitable starting materials would include natural fatty substances as derived from tallow, palm oil, etc.

The preferred alkyl ester sulfonate surfactant, especially for laundry applications, comprises alkyl ester sulfonate surfactants of the structural formula:

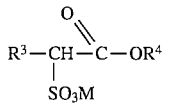

wherein $R^3$ is a $C_8$–$C_{20}$ hydrocarbyl, preferably an alkyl, or combination thereof, $R^4$ is a $C_1$–$C_6$ hydrocarbyl, preferably an alkyl, or combination thereof, and M is a cation which forms a water soluble salt with the alkyl ester sulfonate. Suitable salt-forming cations include metals such as sodium, potassium, and lithium, and substituted or unsubstituted ammonium cations, such as monoethanolamine, diethanolamine, and triethanolamine. Preferably, $R^3$ is $C_{10}$–$C_{16}$ alkyl, and $R^4$ is methyl, ethyl or isopropyl. Especially preferred are the methyl ester sulfonates wherein $R^3$ is $C_{14}$–$C_{16}$ alkyl.

Alkyl Sulfate Surfactant

Alkyl sulfate surfactants hereof are water soluble salts or acids or the formula $ROSO_3M$ wherein R preferably is a $C_{10}$–$C_{24}$ hydrocarbyl, preferably an alkyl or hydroxyalkyl having a $C_{10}$–$C_{20}$ alkyl component, more preferably a $C_{12}$–$C_{18}$ alkyl or hydroxyalkyl, and M is H or a cation, e.g., an alkali metal cation (e.g., sodium, potassium, lithium), or ammonium or substituted ammonium (e.g., methyl-, dimethyl-, and trimethyl ammonium cations and quaternary ammonium cations, such as tetramethyl-ammonium and dimethyl piperdinium cations and quarternary ammonium cations derived from alkylamines such as ethylamine, diethylamine, triethylamine, and mixtures thereof, and the like). Typically, alkyl chains of $C_{12-16}$ are preferred for lower wash temperatures (e.g., below about 50° C.) and $C_{16-18}$ alkyl chains are preferred for higher wash temperatures (e.g., above about50° C.).

Alkyl Alkoxylated Sulfate Surfactant

Alkyl alkoxylated sulfate surfactants hereof are water soluble salts or acids of the formula $RO(A)_mSO_3M$ wherein R is an unsubstituted $C_{10}$–$C_{24}$ alkyl or hydroxyalkyl group having a $C_{10}$–$C_{24}$ alkyl component, preferably a $C_{12}$– $C_{20}$ alkyl or hydroxyalkyl, more preferably $C_{12}$–$C_{18}$ alkyl or hydroxyalkyl, A is an ethoxy or propoxy unit, m is greater than zero, typically between about 0.5 and about 6, more preferably between about 0.5 and about 3, and M is H or a cation which can be, for example, a metal cation (e.g., sodium, potassium, lithium, calcium, magnesium, etc.), ammonium or substituted-ammonium cation. Alkyl ethoxylated sulfates as well as alkyl propoxylated sulfates are contemplated herein. Specific examples of substituted ammonium cations include methyl-, dimethyl-, trimethylammonium and quaternary ammonium cations, such as tetramethyl-ammonium, dimethyl piperdinium and cations derived from alkanolamines such as ethylamine, diethylamine, triethylamine, mixtures thereof, and the like. Exemplary surfactants are $C_{12}$–$C_{18}$ alkyl polyethoxylate (1.0) sulfate, $C_{12}$–$C_{18}E(1.0)M$), $C_{12}$–$C_{18}$ alkyl polyethoxylate (2.25) sulfate, $C_{12}$–$C_{18}E(2.25)M$), $C_{12}$–$C_{18}$ alkyl polyethoxylate (3.0) sulfate $C_{12}$–$C_{18}E(3.0)$, and $C_{12}$–$C_{18}$ alkyl polyethoxylate (4.0) sulfate $C_{12}$–$C_{18}E(4.0)M$), wherein M is conveniently selected from sodium and potassium.

Other Anionic Surfactants

Other anionic surfactants useful for detersive purposes can also be included in the laundry detergent compositions of the present invention. These can include salts (including, for example, sodium, potassium, ammonium, and substituted ammonium salts such as mono-, di- and triethanolamine salts) of soap, $C_9$–$C_{20}$ linear alkylbenzenesulphonates, $C_8$–$C_{22}$ primary or secondary alkanesulphonates, $C_8$–$C_{24}$ olefinsulphonates, sulphonated polycarboxylic acids prepared by sulphonation of the pyrolyzed product of alkaline earth metal citrates, e.g., as described in British patent specification No. 1,082,179, $C_8$–$C_{24}$ alkylpolyglycolethersulfates (containing up to 10 moles of ethylene oxide); acyl glycerol sulfonates, fatty oleyl glycerol sulfates, alkyl phenol ethylene oxide ether sulfates, paraffin sulfonates, alkyl phosphates, isethionates such as the acyl isethionates, N-acyl taurates, alkyl succinamates and sulfosuccinates, monoesters of sulfosuccinate (especially saturated and unsaturated $C_{12}$–$C_{18}$ monoesters) diesters of sulfosuccinate (especially saturated and unsaturated $C_6$–$C_{14}$ diesters), acyl sarcosinates, sulfates of alkylpolysaccharides such as the sulfates of alkylpolyglucoside, branched primary alkyl sulfates, alkyl polyethoxy carboxylates such as those of the formula $RO(CH_2CH_{20})_kCH_2COO—M^+$ wherein R is a $C_8$–$C_{22}$ alkyl, k is an integer from 0 to 10, and M is a soluble salt-forming cation. Resin acids and hydrogenated resin acids are also suitable, such as rosin, hydrogenated rosin, and resin acids and hydrogenated resin acids present in or derived from tall oil. Further examples are given in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23 (herein incorporated by reference).

When included therein, the laundry detergent compositions of the present invention typically comprise from about 1% to about 40%, preferably from about 3% to about 20% by weight of such anionic surfactants.

Other Surfactants

The laundry detergent compositions of the present invention may also contain cationic, ampholytic, zwitterionic, and semi-polar surfactants, as well as nonionic surfactants other than those already described herein, including the semi-polar nonionic amine oxides described below.

Cationic detersive surfactants suitable for use in the laundry detergent compositions of the present invention are those having one long-chain hydrocarbyl group. Examples of such cationic surfactants include the ammonium surfactants such as alkyldimethylammonium halogenides, and those surfactants having the formula:

$$R^1R^2R^3R^4N^+X^-$$

wherein $R^1$ is an alkyl or alkyl benzyl group having from about 8 to about 18 carbon atoms in the alkyl chain, each of $R^2$, $R^3$, $R^4$ is independently $C_1$–$C_4$ alkyl, $C_1$–$C_4$ hydroxy alkyl, benzyl, and —$(C_2H_4)$xH where x has a value from 2 to 5, and $X^-$ is an anion. Not more than one of $R_2$, $R_3$, $R_4$ should be benzyl.

The preferred alkyl chain length for $R^1$ is $C_{12}$–$C_{15}$, particularly where the alkyl group is a mixture of chain lengths derived from coconut or palm kernel fat, or is derived synthetically by olefin build up or OXO alcohols synthesis. Preferred groups for $R_2$, $R_3$, $R_4$ are methyl and hydroxyethyl groups, and the anion X may be selected from halide, methosulphate, acetate and phosphate ions. Examples of suitable quaternary ammonium compounds for use herein are:

coconut trimethyl ammonium chloride or bromide coconut methyl dihydroxyethyl ammonium chloride or bromide decyl triethyl ammonium chloride or bromide decyl dimethyl hydroxyethyl ammonium chloride or bromide C12–14 dimethyl hydroxyethyl ammonium chloride or bromide myristyl trimethyl ammonium methyl sulphate lauryl dimethyl benzyl ammonium chloride or bromide lauryl methyl (ethenoxy)$_4$ ammonium chloride or bromide The above water-soluble cationic components of the compositions of the present invention, are capable of existing in cationic form in a 0.1% aqueous solution at pH10.

Other cationic surfactants useful herein are also described in U.S. Pat. No. 4,228,044, Cambre, issued Oct. 14, 1980, incorporated herein by reference. p When included therein, the laundry detergent compositions of the present invention typically comprise from 0% to about 25%, preferably form about 3% to about 15% by weight of such cationic surfactants.

Ampholytic surfactants are also suitable for use in the laundry detergent compositions of the present invention. These surfactants can be broadly described as aliphatic derivatives of secondary or tertiary amines, or aliphatic derivatives of heterocyclic secondary and tertiary amines in which the aliphatic radical can be straight- or branched chain. One of the aliphatic substituents contains at least 8 carbon atoms, typically from about 8 to about 18 carbon atoms, and at least one contains an anionic water-solubilizing group e.g. carboxy, sulfonate, sulfate. See U.S. Pat. No. 3,929,678 to Laughlin et al., issued Dec. 30, 1975 at column 19, lines 18–35 (herein incorporated by reference) for examples of ampholytic surfactants.

When included therein, the laundry detergent compositions of the present invention typically comprise form 0% to about 15%, preferably from about 1% to about 10% by weight of such ampholytic surfactants.

Zwitterionic surfactants are also suitable for use in laundry detergent compositions. These surfactants can be broadly described as derivatives of secondary and tertiary amines, derivates of heterocyclic secondary and tertiary amines, or derivatives of quaternary ammonium, quarternary phosphonium or tertiary sulfonium compounds. See U.S. Pat. No. 3,929,678 to Laughlin et al., issued Dec. 30, 1975 at columns 19, line 38 through column 22, line 48 (herein incorporated by reference) for examples of zwitterionic surfactants.

When included therein, the laundry detergent compositions of the present invention typically comprise form 0% to about 15%, preferably from about 1% to about 10% by weight of such zwitterionic surfactants.

Semi-polar nonionic surfactants are a special category of nonionic surfactants which include water-soluble amine oxides containing one alkyl moiety of from about 10 to about 18 carbon atoms and 2 moieties selected from the group consisting af alkyl groups and hydrocyalkyl groups containing form about 1 to about 3 carbon atoms; water-soluble phosphine oxides containing one alkyl moiety of form about 10 to about 18 carbon atoms and 2 moieties selected form the group consisting of alkyl groups and hydroxyalkyl groups containing from about 1 to about 3 carbon atoms.

Semi-polar nonionic detergent surfactants include the amine oxide surfactants having the formula:

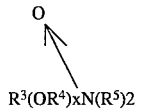

wherein $R^3$ is an alkyl, hydroxyalkyl, or alkyl phenyl group or mixtures thereof containing from about 8 to about 22 carbon atoms; $R^4$ is an alkylene or hydroxyalkylene group containing from about 2 to about 3 carbon atoms or mixtures thereof; x is form 0 to about 3; and each $R^5$ is an alkyl or hydroxyalkyl group containing form about 1 to about 3 carbon atoms or a polyethylene oxide group containing from about 1 to about 3 ethylene oxide groups. The $R^5$ groups can be attached to each other, e.g., through an oxygen or nitrogen atom, to form a ring structure.

There amine oxide surfactants in particular include $C_{10}$–$C_{18}$ alkyl dimenthyl amine oxides and $C_8$–$C_{12}$ alkoxy ethyl dihydroxy ethyl amine oxides. p When included therein, the laundry detergent compositions of the present invention typically comprise form 0% to about 15%, preferably from about 1% to about 10% by weight of such semi-polar nonionic surfactants.

Builders and Other Optional Ingredients

Sodium aluminosilicate may take many forms. One example is crystalline aluminosilicate ion exchange material of the formula $$Na_z[(AlO_2)_z.\ (SiO_2)_y].\ xH_2O$$

wherein z and y are at least about 6, the molar ratio of z to y is from about 1.0 to about 0.4 and z is from about 10 to about 264. Amorphous hydrated aluminosilicate materials useful herein have the empirical formula $$M_z(zAlO_2.\ ySiO_2)$$

wherein M is sodium, potassium, ammonium or substituted ammonium, z is from about 0.5 to about 2 and y is 1, said material having a magnesium ion exchange capacity of at least about 50 milligram equivalents of $CaCO_3$ hardness per gram of anhydrous aluminosilicate. Hydrated sodium Zeolite A with a particle size of from about 1 to 10 microns is preferred.

The aluminosilicate ion exchange builder materials herein are in hydrated form and contain from about 10% to about 28% of water by weight if crystalline, and potentially even higher amounts of water if amorphous. Highly preferred crystalline aluminosilicate ion exchange materials contain from about 18% to about 22% water in their crystal matrix. The crystalline aluminosilicate ion exchange materials are further characterized by a particle size diameter of from about 0.1 micron to about 10 microns. Amorphous materials are often smaller, e.g., down to less than about 0.01 micron. Preferred ion exchange materials have a particle size diameter of from about 0.2 micron to about 4 microns. The term "particle size diameter" herein represents the average particle size diameter by weight of a given ion exchange material as determined by conventional analytical techniques such as, for example, microscopic determination utilizing a scanning electron microscope. The crystalline aluminosilicate ion exchange materials herein are usually further characterized by their calcium ion exchange capacity, which is at least about 200 mg equivalent of $CaCO_3$ water hardness/g of aluminosilicate, calculated on an anhydrous basis, and which generally is in the range of from about 300 mg eq./g to about 352 mg eq./g. The aluminosilicate ion exchange materials herein are still further characterized by their calcium ion exchange rate which is at least about 2 grains $Ca^{++}$/gallon/minute/gram/gallon of aluminosilicate (anhydrous basis), and generally lies within the range of from about 2 grains/gallon/minute/gram/gallon to about 6 grains/gallon/minute/gram/gallon, based on calcium ion hardness. Optimum aluminosilicate for builder purposes exhibit a calcium ion exchange rate of at least about 4 grains/gallon/minute/gram/gallon.

The amorphous aluminosilicate ion exchange materials usually have a $Mg^{++}$ exchange of at least about 50 mg eq. $CaCO_3$/g (12 mg $Mg^{++}$/g) and a $Mg^{++}$ exchange rate of at least about 1 grain/gallon/minute/gram/gallon. Amorphous materials do not exhibit an observable diffraction pattern when examined by Cu radiation (1.54 Angstrom Units).

Aluminosilicate ion exchange materials useful in the practice of this invention are commercially available. The aluminosilicates useful in this invention can be crystalline or amorphous in structure and can be naturally occurring aluminosilicates or synthetically derived. A method for producing aluminosilicate ion exchange materials is discussed in U.S. Pat. No. 3,985,669, Krummel et al., issued Oct. 12, 1976, incorporated herein by reference. Preferred synthetic crystalline aluminosilicate ion exchange materials useful herein are available under the designations Zeolite A, Zeolite B, Zeolite M and Zeolite X. In an especially preferred embodiment, the crystalline aluminosilicate ion exchange material has the formula $$Na_{12}[(AlO_2)_{12}(SiO_2)_{12}].\ xH_2O$$

wherein x is from about 20 to about 30, especially about 27 and has a particle size generally less than about 5 microns.

Other ingredients which are known for use in the components and compositions may also be used as optional ingredients in the present invention.

The granular detergents of the present invention can contain neutral or alkaline salts which have a pH in solution of seven or greater, and can be either organic or inorganic in nature. The builder salt assists in providing the desired density and bulk to the detergent granules herein. While some of the salts are inert, many of them also function as detergency builder materials in the laundering solution.

Examples of neutral water-soluble salts include the alkali metal, ammonium or substituted ammonium chlorides, fluorides and sulfates. The alkali metal, and especially sodium, salts of the above are preferred. Sodium sulfate is typically used in detergent granules and is a particularly preferred salt. Citric acid and, in general, any other organic or inorganic acid may be incorporated into the granular detergents of the present invention as long as it is chemically compatible with the rest of the agglomerate composition.

Other useful water-soluble salts include the compounds commonly known as detergent builder materials. Builders are generally selected from the various water-soluble, alkali metal, ammonium or substituted ammonium phosphates, polyphosphates, phosphonates, polyphosphonates, carbonates, silicates, borates, and polyhyroxysulfonates. Preferred are the alkali metal, especially sodium, salts of the above.

Specific examples of inorganic phosphate builders are sodium and potassium tripolyphosphate, pyrophosphate, polymeric metaphosphate having a degree of polymerization of from about 6 to 21, and orthophosphate. Examples of polyphosphonate builders are the sodium and potassium salts of ethylene diphosphonic acid, the sodium and potassium salts of ethane 1-hydroxy-1,1-diphosphonic acid and the sodium and potassium salts of ethane, 1,1,2-triphosphonic acid. Other phosphorus builder compounds are disclosed in U.S. Pat. Nos. 3,159,581; 3,213,030; 3,422,021; 3,422,137; 3,400,176 and 3,400,148, incorporated herein by reference.

Examples of nonphosphorus, inorganic builders are sodium and potassium carbonate, bicarbonate, sesquicarbonate, tetraborate decahydrate, and silicate having a moiar ratio of $SiO_2$ to alkali metal oxide of from about 0.5 to about 4.0, preferably from about 1.0 to about 2.4.

As mentioned above powders normally used in detergents such as zeolite, carbonate, silica, silicate, citrate, phosphate, perborate, etc. and process acids such as starch, can be used in preferred embodiments of the present invention.

Polymers

Also useful are various organic polymers, some of which also may function as builders to improve detergency. Included among such polymers may be mentioned sodium carboxy-lower alkyl celluloses, sodium lower alkyl celluloses and sodium hydroxy-lower alkyl celluloses, such as sodium carboxymethyl cellulose, sodium methyl cellulose and sodium hydroxypropyl cellulose, polyvinyl alcohols (which often also include some polyvinyl acetate), polyacrylamides, polyacrylates and various copolymers, such as those of maleic and acrylic acids. Molecular weights for such polymers vary widely but most are within the range of 2,000 to 100,000.

Polymeric polycarboxylate builders are set forth in U.S. Pat. No. 3,308,067, Diehl, issued Mar. 7, 1967. Such materials include the water-soluble salts of homo-and copolymers of aliphatic carboxylic acids such as maleic acid, itaconic acid, mesaconic acid, fumaric acid, aconitic acid, citraconic acid and methylenemalonic acid.

Other Optionals Ingredients

Other ingredients commonly used in detergent compositions can be included in the components and compositions of the present invention. These include color speckles, bleaching agents and bleach activators, suds boosters or suds suppressors, antitarnish and anticorrosion agents, soil suspending agents, soil release agents, dyes, fillers, optical brighteners, germicides, pH adjusting agents, nonbuilder alkalinity sources, hydrotropes, enzymes, enzyme-stabilizing agents, and perfumes.

EXAMPLES

In these examples the following abbreviations have been used:

C25E3: C12–15 alkyl ethoxylate, with an average of 3 ethoxy groups per molecule

GA: N-methyl glucamide

C25AS: C12–15 alkyl sulphate

C45AS: C14–15 alkyl sulphate

C25AE3S: C12–15 alkyl ethoxy sulphate, with an average of 3 ethoxy groups per molecule PVP: Polyvinyl Pyrrolidone PVNO: Polyvinyl Pyrridine N oxide

TABLE 1

| Ex | 1 | 2 | 3 | 4 | 5 | 6 | 7 | 8 | 9 | 10 | A |
|---|---|---|---|---|---|---|---|---|---|---|---|
| C25E3 | 80 | 75 | 67 | 67 | 46 | 46 | 46 | 75 | 67 | 86 | 97.5 |
| GA | | | | | | | | 12.5 | 11 | | |
| PVP | 20 | 25 | 33 | 33 | | | | | 22 | 14 | 2.5 |
| PVNO | | | | | 13 | 13 | 13 | 12.5 | | | |
| lactose | | | | | 11 | | | | | | |
| dextrose | | | | | | 11 | | | | | |
| sucrose | | | | | | | 11 | | | | |
| water | | | | | 30 | 30 | 30 | | | | |
| Operating Temp.(°C.) | 30 | 30 | 15 | 15 | 20 | 20 | 20 | 40 | 40 | 20 | 20 |
| Viscosity (mPas) | 900 | 1300 | 2000 | 2000 | 23000 | 23000 | 23000 | 24000 | 15000 | 380 | 50 |

Example 1

The C25E3/PVP paste defined in Table 1 was sprayed into a Loedige CB mixer [Trade Name] at a rate of 1120 kg/hr and at a temperature of 30° C. At the same time zeolite A was added to the mixer at a rate of 1340 kg/hr, as well as anhydrous carbonate 1340 kg/hr.

Dispersion of the paste premix and high intensity mixing of the premix and the powders occurred in the Loedige mixer. The residence time was approximately eight seconds. The resulting mixture was fed into a Loedige KM mixer [Trade Name] and distinct agglomerates were formed. Two high speed choppers in the first half of the Loedige KM mixer prevented a high proportion of oversize agglomerates being formed.

In the second half of the Loedige KM mixer water was sprayed on to the agglomerates at a rate of 225 kg/hr promoting the hydration of the carbonate in the agglomerate.

After the water spray on, a mixture of zeolite and silica was added at a rate of 160 kg/hr. The agglomerates leaving the Loedige KM mixer were then passed through a fluid bed cooler/elutriator The resulting agglomerates had excellent physical properties including flowability, and were found to be physically stable under stressed storage conditions.

Example 2

The process of example 1 was repeated using the components listed in Table 1.

Example 3

The process of example 1 was repeated using the components listed in Table 1 and at an operating temperature of the paste premix of 15° C.

Example 4

The process of example 3 was repeated using the components listed in Table 1, with the Zeolite A being replaced by anhydrous citrate, and the rate of water addition being increased to 190 kg/hr.

Example 5

The C25E3/PVNO/lactose paste defined in Table 1 was sprayed into a Loedige CB mixer [Trade Name] at a rate of 1400 kg/hr and at a temperature of 20° C. At the same time zeolite A was added to the mixer at a rate of 1200 kg/hr, as well as anhydrous carbonate 1200 kg/hr. The remainder of the process was carried out as in example 1 with water being sprayed on to the agglomerates at a rate of 200 kg/hr.

Examples 6–10

The process of example 5 was repeated using the components listed in Table 1.

In each of the examples 2 to 10, a free flowing granular products were produced which were found to be physically stable under stressed storage conditions.

Comparative Example A

The process of example 5 was repeated using the components listed in Table 1. Due to the lower viscosity of the surfactant premix it was not possible to make granules having the desired particle size or physical properties.

We claim:

1. A process for making a granular laundry detergent component or composition having a bulk density of at least 650 g/l comprising the steps of:

a) dissolving a structuring agent, said structuring agent comprising a polymer, in a nonionic surfactant to form a pumpable premix; and b) finely dispersing said premix wiih an effective amount of powder characterized in that the fine dispersing of the premix is carded out at an operating temperature of from about 15° to 30° C., and at which the premix has a viscosity of from about 380 to about 23,000 mPas when measured at said operating temperature and at a shear rate of $25s^{-1}$; wherein said powder is selected from the group consisting of zeolite, silica, carbonate, silicate, sulfate, phosphate, citrate, citric acid or mixtures of these.

2. A process according to claim 1 wherein the structuring agent comprises at least one ingredient having more than one hydroxyl functional group.

3. A process according to claim 2 wherein the structuring agent is selected from the group consisting of dextrose, lactose, sucrose, saccharin and derivatives, including polyhydroxy fatty acid amides.

4. A process according to claim 1 wherein the structuring agent is selected from the group consisting of polyvinyl pyrrolidone, polyvinyl pyrridine N oxide, polyvinyl alcohols, polyhydroxyacrylic acid polymers, and mixtures of these.

5. A process according claim 4 characterized in that the structuring agent is a polymer having a molecular weight of at least 2000.

6. A process according to claim 1 wherein the structuring agent is selected from the group consisting of phthalimide, para-toluene sulphonamide, maleimide and mixtures of these.

7. A process according claim 1 wherein the granular laundry detergent component or composition comprises at least 10% by weight of nonionic surfactant.

8. A process for making a granular laundry detergent component or composition having a bulk density of at least 650 g/l comprising the steps of:

a) dissolving a structuring agent, said structuring agent comprising a polymer, in a nonionic surfactant to form a premix; and b) mixing said premix with an effective amount of powder by spraying said premix onto said powder in a low shear mixer or a rotating drum characterized in that the premix is sprayed at an operating temperature of from about 15° to about 30° C., and at which said premix has a viscosity of from about 380 to about 23,000 mPas when measured at said operating temperature and at a shear rate of $25s^{-1}$; wherein said powder is selected from the group consisting of zeolite, silica, carbonate, silicate, sulfate, phosphate, citrate, citric acid or mixtures of these.

9. A process according to claim 8 in which the powder in step b) is a granular detergent which comprises particles prepared by spray drying, agglomeration, or mixtures of these.

10. A process for making a granular laundry detergent component or composition having a bulk density of at least 650 g/l comprising the steps of:

a) dissolving a structuring agent comprising a polymer in a nonionic surfactant to form a pumpable premix;

b) finely dispersing said premix with an effective amount of powder characterized in that the fine dispersing of the premix is carried out at an operating temperature of from about 15° to about 30° C., and at which said premix has a viscosity of from about 380 to about 23,000 mPas when measured at said operating temperature and at a shear rate of $25s^{-1}$, and that at least some of said powder is in a hydratable form; wherein said powder is selected from the group consisting of zeolite, silica, carbonate, silicate, sulfate, phosphate, citrate, citric acid or mixtures of these; and c) spraying water on to the product of step b).

* * * * *